United States Patent [19]

Ichikawa et al.

[11] Patent Number: 4,642,598

[45] Date of Patent: Feb. 10, 1987

[54] ADJUSTING DEVICE FOR THERMAL OVERLOAD RELAY

[75] Inventors: Haruo Ichikawa, Gyooda; Fumio Chida, Kitaadachi; Katsumi Akiike, Fukiage; Kanichi Izumi, Kitasaitama, all of Japan

[73] Assignee: Fuji Electric Co., Ltd., Kawasaki, Japan

[21] Appl. No.: 805,878

[22] Filed: Dec. 6, 1985

[30] Foreign Application Priority Data

| | | | |
|---|---|---|---|
| Dec. 28, 1984 | [JP] | Japan | 59-200408[U] |
| Dec. 28, 1984 | [JP] | Japan | 59-200409[U] |
| Jan. 21, 1985 | [JP] | Japan | 60-6679[U] |
| Jan. 24, 1985 | [JP] | Japan | 60-8146[U] |

[51] Int. Cl.[4] ..... H01H 61/00; H01H 71/16

[52] U.S. Cl. ..... 337/82; 337/57; 335/45

[58] Field of Search ..... 337/357, 360, 361, 368, 337/347, 94, 82, 57; 335/43, 45

[56] References Cited

U.S. PATENT DOCUMENTS

| | | | |
|---|---|---|---|
| 3,903,493 | 9/1975 | Richards et al. | 337/57 |
| 4,023,132 | 5/1977 | Kidd et al. | 337/82 |

*Primary Examiner*—Harold Broome

*Attorney, Agent, or Firm*—Brumbaugh, Graves, Donohue & Raymond

[57] ABSTRACT

A thermal overload relay of the type which uses a shifter to transmit thermal bending of the main bimetallic element to one end of the temperature compensating bimetallic element which is connected to a release lever which controls the closing of the relay and which includes an adjusting link which has an eccentric stem whose degree of rotation controls the setting of the release lever. As a calibration control to correct for unintended manufacturing variations and aging effects, the adjusting link supports an adjustment pin with an eccentric stem which abuts the eccentric stem of the adjusting dial to provide further control of the setting of the release lever.

5 Claims, 15 Drawing Figures

ADJUSTING DEVICE FOR THERMAL OVERLOAD RELAY

This invention relates to a relay which responds to thermal overloads.

BACKGROUND OF THE INVENTION

An essential portion of a popular form of thermal overload relay is shown in FIG. 1. As shown, the main components are all included in the insulated housing 1. These include the bimetallic element 2 on which are wound the heating elements (not shown) in which flow the control current, a shifter 6 which engages the free end of the bimetallic element and is adapted to move in the direction of arrow P along a groove in the housing, a switching assembly 3 which is coupled to one end of the shifter 6 and a contact assembly 4 which is opened or shut by the switching assembly through a reversing assembly 5.

The switching assembly 3 includes a temperature compensating element 8 having a leading end portion to which is attached an adjusting screw 7. The adjusting screw 7 engages one end of the shifter 6. The temperature compensating element 8 is integrated with a release lever 9, which is able to turn on the hinge point X. An adjusting link 10 is interposed between the adjustment knob or dial 12 and the release lever 9 which is enabled to turn about the fulcrum W. A spring 11 has one end held by a tongue 10*a* of the adjusting link 10 and its other end held by the housing for urging the head 10*b* of adjusting link 10 against the eccentric pin or cam 12*a* of the adjusting dial 12.

The reversing assembly 5 includes a moveable plate 16 which supports an insulating member 17 having one end inserted in a V-shaped groove 13*a* in the terminal plate 13 and the other end attached to a normally-opened side moveable contact 15 of the contract assembly 4. A contact controlling spring 14 is connected under tension between a saw-tooth groove 13*b* in the terminal plate 13 and the moveable plate 16 for reversing the plate 16 when its operating line crosses the V-shaped groove 13*a* (located at point Z) supporting the moveable plate 16.

The contact assembly 4 includes the moveable plate 16 and the terminal plate 13, which are also part of the reversing assembly, the insulating member 17 for driving the normally-opened side moveable contact 15, a normally-closed side moveable contact 18, a normally-open side moveable contact 20 which is arranged to face the normally-opened side moveable contact 15 and is fixed on the housing by terminal plate 19, which is adapted to be driven during operation of the moveable plate 16 by the insulating member 17, and a normally closed side fixed contact 22 which is arranged to face the normally closed side moveable contact 18 and is fixed on the housing by terminal plate 23.

In this relay, when an overcurrent flows in the heating element of the temperature sensitive bimetallic element 2, the latter bends and shifter 6 is moved in the direction P by movement of the free end of the element 2. When the shifter 6 moves, adjusting screw 7 which is attached to the leading edge of the temperature compensating bimetallic element 8 is pushed so that the release lever 9 is turned clockwise on the hinge pin X. As a result, the spring 14 of reversing mechanism 5 has its portion 14*a* moved in the direction of arrow Q. At this time, the initial turning angle of the release lever 9, with which element 8 is integrated, is set at a predetermined position by the movment of the hinge point X by the adjusting line 10, according to the setting of the adjusting dial 12. When the turn of the release lever 9 proceeds so that the operating line of the spring 14 passes its neutral point, the moveable plate 16 is reversed on the point Z from the shown position and the relay closes.

In this relay, the moveable plate 16 may have unintended variations in its reversing point or may fail to operate as a result of positioning variations of the adjusting dial 12, the bimetallic element 2 or size variations in the component parts. To compensate for those variations in fixing the operating point, a change in the adjusting screw 7 is used. For example, if a gap is formed in the desired contact between the shifter 6 and the temperature compensating element 8 because of these variations, even when overcurrent is flowing through the heating element, the operating line of the spring 14 may fail to cross its neutral point and the moveable plate not be reversed. In this case it is the practice to insert a screw driver in an opening 24 in the housing to adjust the adjusting screw 7 to eliminate the gap and to set operation at the desired point. Alternatively, if the turning operation of the moveable plate is too advanced because of unintended variations, the desired operating pont can be re-adjusted by loosening the adjusting screw. Since the adjusting screw is attached to the leading end of the temperature compensating element 8, the relay tends to be sensitive to vibrations. Moreover, since the adjustment of screw has to be conducted in the direction of movement of shifter 6, the opening 24 needs to be formed in the side of the housing and the strength of the sidewall is reduced. Moreover, to provide a side opening in a manner to prevent the entrance of foreign matter increases production costs. The present invention seeks to improve on these shortcomings of a relay of the kind described.

SUMMARY OF THE INVENTION

The present invention improves on the relay of the kind described by a novel arrangement for adjusting the operating point of the relay.

The present invention seeks to simplify the prior art relay by providing the function of the adjusting screw of the prior art relay, i.e., the calibration of the operating point for manufacturing variations in the properties, sizes and assembly of the components of the relay, and any aging effects by a novel adjustment means which cooperates with and supplements the adjusting dial normally included to permit setting of the operating or triggering temperature of the relay.

In particular, various embodiments of the invention are provided in which the adjustment means is a pin which is supported on the adjusting link and includes an eccentric cam portion which abuts against the eccentric stem of the adjusting dial and whose rotation further controls the spacing between the temperature compensating bimetal and the release lever.

The invention will be better understood from the following more detailed description taken in conjunction with the accompanying drawings.

DETAILED DESCRIPTION OF THE INVENTION

Figure 1:
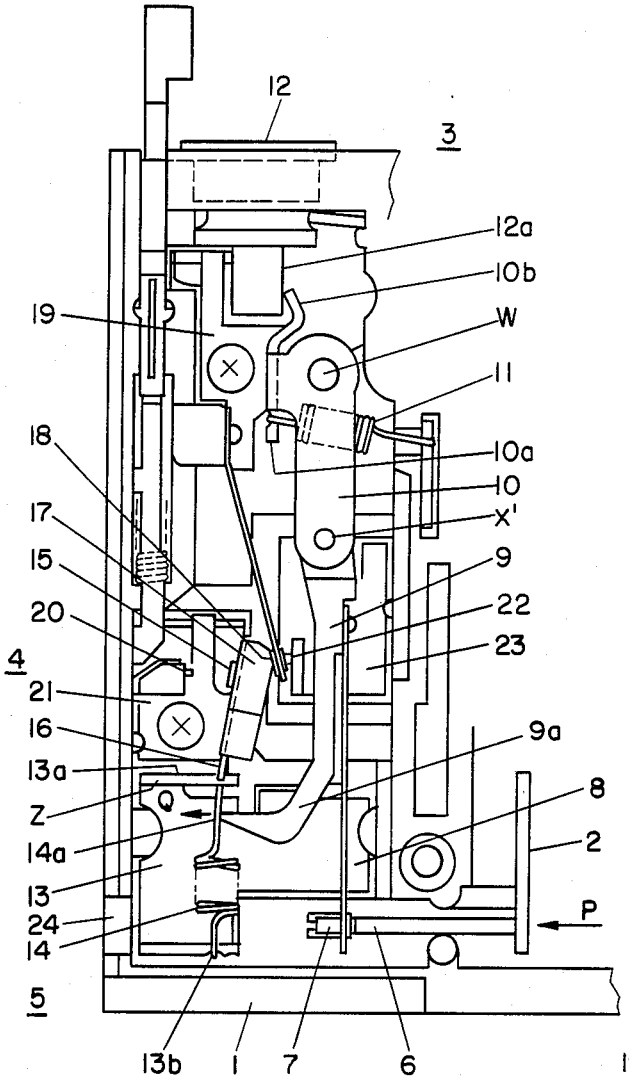
FIG. 1 PRIOR ART
FIG. 1 is a front view with the front cover removed of the prior art relay of which the invention is an improvement.
Figure 2:
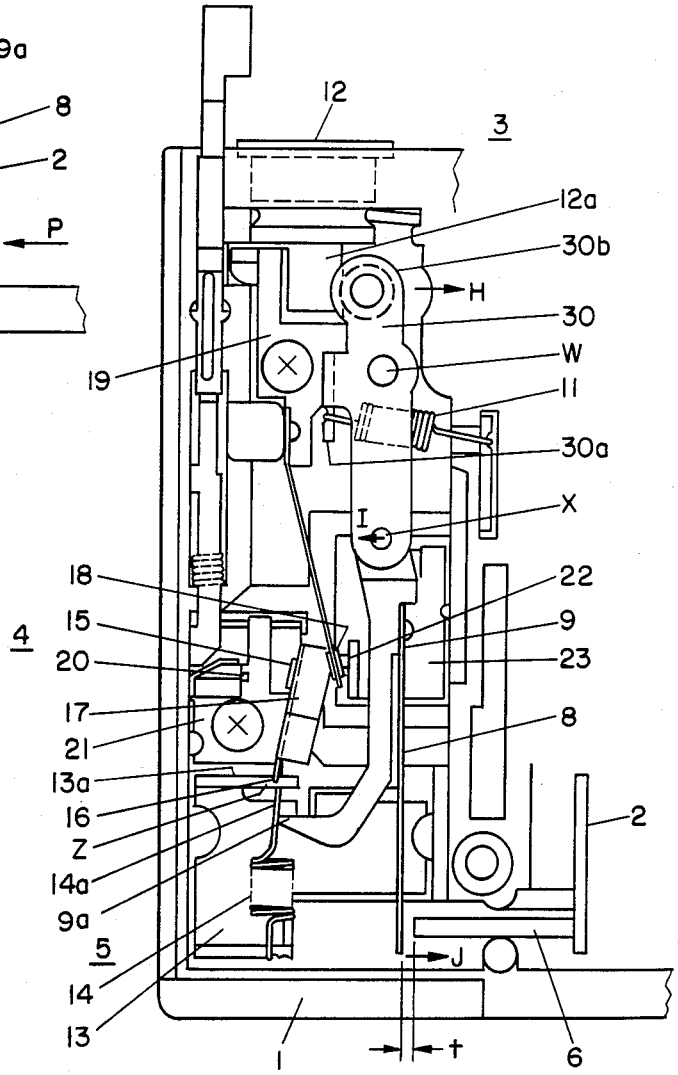
FIG. 2 is a similar view of a preferred embodiment of the invention.

With reference now to the drawings, in the improved relay of FIG. 2, the elements corresponding to those in the prior art relay discussed above with reference to FIG. 1, have been given the same reference characters that they had in FIG. 1 and their description will not be repeated in detail.

The distinctive difference of the embodiment of the invention shown in FIG. 2 is the difference in the new adjusting link 30, substituted for the old adjusting link 10 and its relation to the added adjusting pin 31 which is designed to cooperate with the adjusting knob 12.

In this embodiment the cooperation of the adjusting link 30 and the adjusting pin 31 obviates the need for the adjusting screw 7 in the prior art device shown in FIG. 1. Rotation of an eccentric cam portion of the adjusting pin 31 changes the position of the bimetallic element 8 to compensate for any gap that develops because of the various factors mentioned above, between the engaging portions of the shifter 6 and the temperature compensating bimetallic element 8. In particular, movement of the head portion **30*b* of the adjusting link 30 in the direction shown by the arrow H around the fulcrum W results in movement of the hinge point X in the opposite direction shown by the arrow I. Movement of the hinge point in the direction I moves the leading edge of the element 8, integrated with release lever 9, in the direction indicated by the arrow J on the push portion 9*a* of the release lever 9, which abuts against the midslope portion 14*a* of the tension spring 14. As a result the leading edge of the bimetallic element 8 can be moved towards the shifter 6 to eliminate the gap by turning the pin 31**.

The desired operating point, as before, is controlled by rotation of the eccentric cam stem portion **12*a* of the adjusting link 31*b* in the manner that it did on the head portion 10*a* of the adjusting link 10 in the device of FIG. 1 and provides an additional control on the amount of turn of the adjusting link 30 about the fulcrum W for controlling the amount of bending the main bimetal element 2 has to undergo to trigger the release lever 9 to close contacts 15 and 20**.

The specific construction of adjusting line 30 and adjusting pin 31 can have a variety of forms and some of the possible variations are shown in the figures to be described.

Figure 3A:
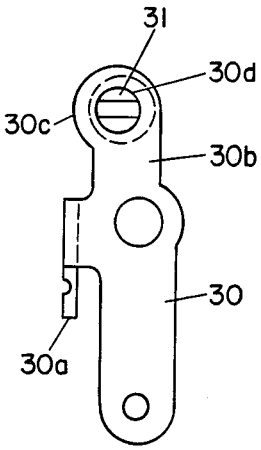
FIGS. 3A–3E are different views on an enlarged scale of the distinctive portion of the embodiment shown in FIG. 2.
Figure 3B:
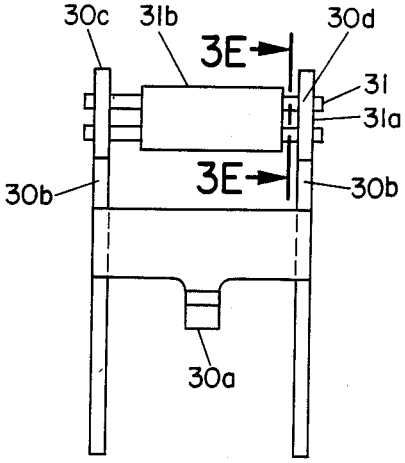
Figure 3C:
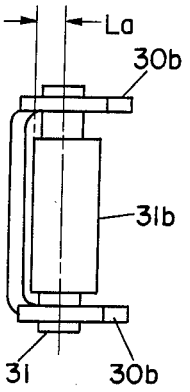
Figure 3D:
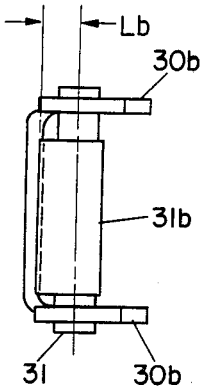
Figure 3E:
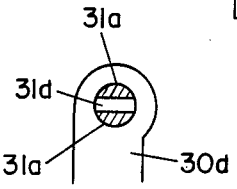

Referring now to FIGS. 3A, 3B, 3C, 3D and 3E, (which show a front view, side view, two top views, and a section taken along the lines E—E of FIG. 3B, respectively) the adjusting link 30 includes a tongue portion **30*a* designed to retain one end of spring 11 (not shown here but seen in FIG. 2). It also includes a pair of head portions 30*b*, one of which is provided with a U-shaped groove 30*c* and the other with a circular opening 30*d*. The inclusion of the U-shaped groove 30*c* permits the adjusting pin 31 to be press fitted into place. The adjusting pin 31 includes bifurcated end portions to provide a pair of support rods 31*a*, substantially semicircular in cross section to be supported within holes 30*c* and 30*d* in the head 30*b* of the link 30 as best seen in FIG. 3E, to leave therebetween a gap 31D into which may be inserted a tool for rotating the pin 31. The rods 31*a*, support the cylindrical stem portion 31*b* which is eccentric so that its rotation varies the amount by which it extends beyond the axis defined by the two holes 30*c* and 30*d*, as best seen in FIGS. 3C and 3D which corresponds to different amounts of rotation. Stem 31*c* is adapted to abut the eccentric stem 12*a* of the adjusting dial 12 and is intially adjusted to achieve the desired closing of the gap between the bimetallic element 8 and the shifter 6, as previously discussed. Thereafter rotation of the adjusting dial 12 to rotate its eccentric stem 12A further moves the central portion 31*b* of the adjusting link 31** to fix the switching temperature.

Figure 4A:
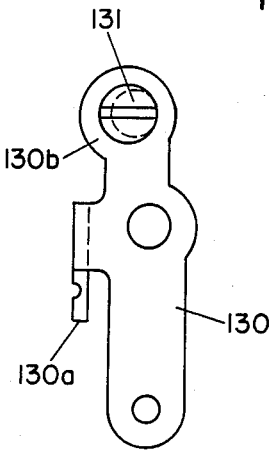
FIGS. 4A–4D and FIGS. 5A–5D are different views of the portion corresponding to that of FIGS. 3 for different embodiments of the invention.
Figure 4B:
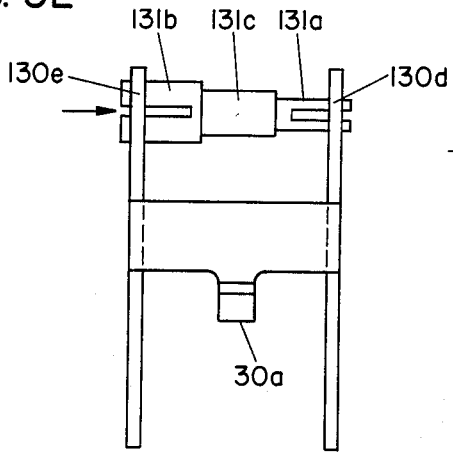
Figure 4C:
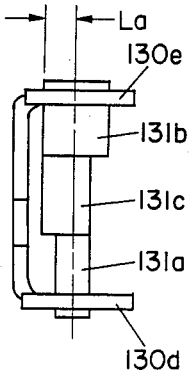
Figure 4D:
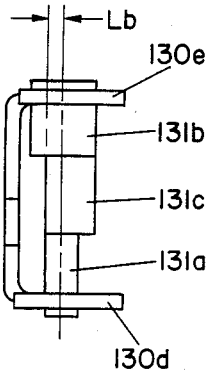

In the variation depicted in FIGS. 4A, 4B, 4C and 4D, instead of a U-shaped groove in one support, round hole **130*d* and 13*e* are used in link 130 but of different sizes so that the adjusting pin 131 may be inserted through the larger hole for assembly. In this instance, one pair of the bifurcated support rods 131*a* is smaller than the other pair 131*b*, because of the different sizes of the holes, but as before they support an eccentric central section 131*c*** which serves as an eccentric cam, as it is rotated, as seen in FIGS. 4C and 4D.

Figure 5A:
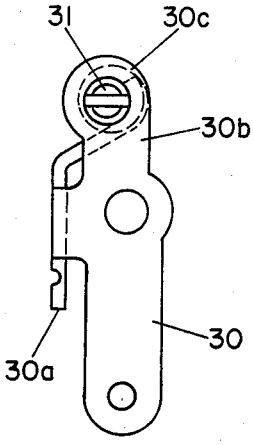
Figure 5B:
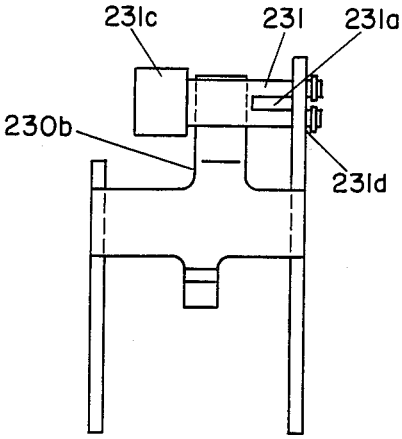
Figure 5C:
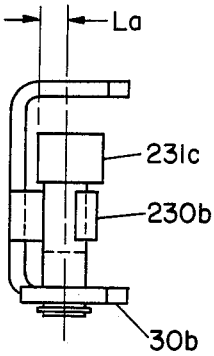
Figure 5D:
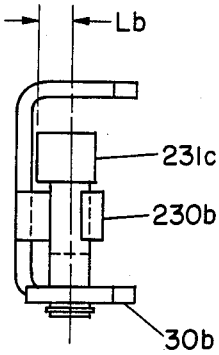

In still another variation shown in FIGS. 5A through 5D, the adjusting pin 231 is held at only one end by the end supports **231*a* rather than at both ends as in the other variations, but it is further supported at an intermediate point by support member 230*b*. As before, there is an eccentric cylindrical stem portion 231*c* which can be rotated to provide an eccentric surface as seen in FIGS. 5C and 5D for abutting the eccentric stem of the adjusting dial. In this instance the bifurcated support rods 231*a* are each provided with a step 231*d* to help keep the pin 231** in place. It should be apparent that a number of variations are possible without deparating from the spirit and scope of the invention.

We claim:

1. In a thermal overload relay which includes a pair of contacts and a main bimetallic element whose bending as a result of thermal overload is transmitted through shifting means to a temperature compensating bimetallic element which controls a release lever whose triggering closes the contacts of the relay and which includes an adjusting means for controlling the setting of the release lever, the amount of bending the bimetallic element has to undergo to trigger the release lever to close the contacts, by the rotation of an adjusting dial which includes an eccentric stem portion, the improvement comprising supplemental means for setting the release lever which comprises an adjusting pin which include an eccentric stem portion which abuts the eccentric stem portion of the adjusting dial and means for rotating said eccentric stem portion of the adjusting pin.

2. A thermal overload relay comprising:

A pair of contacts;

a release lever whose triggering closes the contacts of the relay, thermal means for triggering the release lever upon overload, and means for adjusting the triggering point of the release lever comprising an adjusting means including a dial portion which has an eccentric stem portion whose rotation provides one degree of control of the triggering point of the release lever and including a pin portion which has an eccentric stem portion whose rotation provides a second degree of control of the triggering point of the release lever, the two eccentric stem portions abutting one another to supplement one another.

3. The relay of claim 2 in which the adjusting means includes an adjusting link apertured to support said adjusting pin which is rotatable at one end and which includes said eccentric intermediate stem portion.

4. The relay of claim 3 in which the adjusting link supports opposite ends of the adjusting pin.

5. The relay of claim 4 in which one end of the adjusting pin is bifurcated to form a groove which can be rotated for rotation of the eccentric intermediate stem portion.

* * * * *